US005133331A

United States Patent [19]

Hutchinson

[11] Patent Number: 5,133,331

[45] Date of Patent: Jul. 28, 1992

[54] RECOILLESS AIR GUN

[76] Inventor: Roy Hutchinson, 55 Dale View Avenue, Chingford, London E4, United Kingdom

[21] Appl. No.: 628,361

[22] Filed: Dec. 17, 1990

[30] Foreign Application Priority Data

Dec. 15, 1989 [GB] United Kingdom ..... 8928365

[51] Int. Cl.[5] ..... F41B 11/00

[52] U.S. Cl. ..... 124/68; 124/66

[58] Field of Search ..... 124/68, 67, 66, 65, 124/37; 92/137, 69 R; 417/488

[56] References Cited

U.S. PATENT DOCUMENTS

| | | | |
|---|---|---|---|
| 2,938,513 | 5/1960 | Giss | 124/68 |
| 3,370,581 | 2/1968 | Hills et al. | 124/67 |
| 3,777,626 | 12/1973 | Schurenberg et al. | 92/137 |
| 4,870,945 | 10/1989 | Hutchison | 124/68 |
| 5,035,171 | 7/1991 | Gottling et al. | 92/137 |

FOREIGN PATENT DOCUMENTS

| | | | |
|---|---|---|---|
| 728082 | 4/1955 | United Kingdom | 124/68 |
| 2181524 | 4/1987 | United Kingdom . | |

*Primary Examiner*—Peter M. Cuomo

*Attorney, Agent, or Firm*—Collard & Roe

[57] ABSTRACT

In a recoilless air gun in which opposing pistons are arranged to be propelled simultaneously in opposite directions when the gun is fired, to compress a charge of air to propel a projectile, the pistons are attached to opposing locations on an endless chain or flexible belt extending around spaced apart reversing pulleys, so that as the attachment point of one piston to the chain or flexible belt moves in one direction along one of the runs thereof between the pulleys, the attachment point of the other piston moves in the opposite direction along the other of the runs. The pistons are propelled by respective similar springs so that the effective masses of the springs are also balanced and the flexible belt or chain is required merely to ensure the desired relative positioning of the pistons and is not required to provide the accelerative and air-compressing force for either piston. The pistons may be connected to the belt or chain via respective connecting links and, in order to minimize loads on the trigger sear, the connecting rods may be arranged to be close to dead-center positions with respect to the respective pulleys in the cocked condition of the gun.

5 Claims, 2 Drawing Sheets

RECOILLESS AIR GUN

DESCRIPTION OF INVENTION

This invention relates to air guns and, more particularly to an air gun of the type in which, when the gun is fired, a piston is released to travel along a cylinder, under the influence of a biasing force, to compress a charge of air which is supplied to a barrel of the gun, behind a projectile in the barrel, to fire the projectile from the barrel.

Air guns of the above-noted type, in their simplest form, are subject to substantial recoil, arising from the acceleration and deceleration forces applied to the piston, which is, of course, many times more massive then the projectile fired from the gun, and such recoil is detrimental to accurate aiming and makes such guns generally less pleasant to operate. In order to reduce, or eliminate recoil in such air guns in the past one of the methods has been it has been proposed to utilize two oppositely acting pistons which are released simultaneously when the gun is fired to travel in opposite directions either away from or towards each other along respective cylinders, or along respective parts of the same cylinder, to compress the charge of air needed for firing the projectile, whereby the two pistons 'balance' one another and the recoil forces from the two pistons cancel each other out. Such recoilless air guns are disclosed, for example, in U.S. Pat. No. 2,938,513 and British Patent Specification No. 2181524.

In view of the considerable spring forces involved in operating the pistons, the mechanisms used to achieve the desired balanced operation of the oppositely acting piston must be capable of withstanding substantial forces, without introducing substantial inertia or friction into the system. The arrangement disclosed in GB-A-2181524 meets these requirements in a simple and effective manner by connecting the two pistons by a chain which extends from one piston, around a pulley to the other piston. However, in this arrangement, in order to ensure that the chain remains taut, and thus that the movement of both pistons is accurately controlled, it is necessary to ensure that the spring for the piston nearer the pulley is stronger than that for the other piston and/or that there is a predetermined difference between the masses of the two pistons, producing an imbalance between the two pistons which, if not compensated, will again lead to undesired recoil. Furthermore, trigger loads tend to be unacceptably high unless complex and expensive trigger mechanisms are utilized.

It is an object of the invention to provide an improved recoilless air gun.

According to one aspect of the invention, there is provided a recoilless air gun comprising a piston and a counterweight arranged to be propelled simultaneously in opposite directions when the gun is fired, to cause said piston to compress a charge of air to propel a projectile from the gun, wherein said piston and said counterweight are each attached to an endless flexible driving element, supported for circulating movement around a closed path such that in such circulating movement in one sense the driving element passes along a first run in one direction, around first reversing means, along a second run parallel with the first run, in the direction opposite to said first direction, and around second reversing means into said first run again, the points of attachment of said pistons and said counterweight being such that the point of attachment of attachment of said counterweight is in said second run, whereby the piston and counterweight are constrained to move in opposite directions, said runs being parallel with one another and with said directions of movement of the piston and counterweight. The counterweight will, of course, normally be a second piston which also acts to compress air for firing the projectile.

In a preferred construction allowing substantially reduced trigger loads to be readily achieved, said piston and counterweight, (or both said pistons where the counterweight is in the form of a further piston), are connected to said endless flexible driving element by respective connecting rods or links, in such a manner as to allow the line of action connecting the point of attachment of said connecting rod or link with the flexible driving element, and the point of attachment of the connecting rod or link with its piston, to vary in inclination relative to said runs so the end of each connecting rod or link connected with the flexible driving element can follow the latter at least partially around the respective reversing means, to respective positions where a larger part of the restraining force resisting said biasing means is provided by said reversing means and a smaller part is provided by said release mechanism.

Embodiments of the invention are described below by way of example with reference to the accompanying schematic drawings in which.

Figure 1:
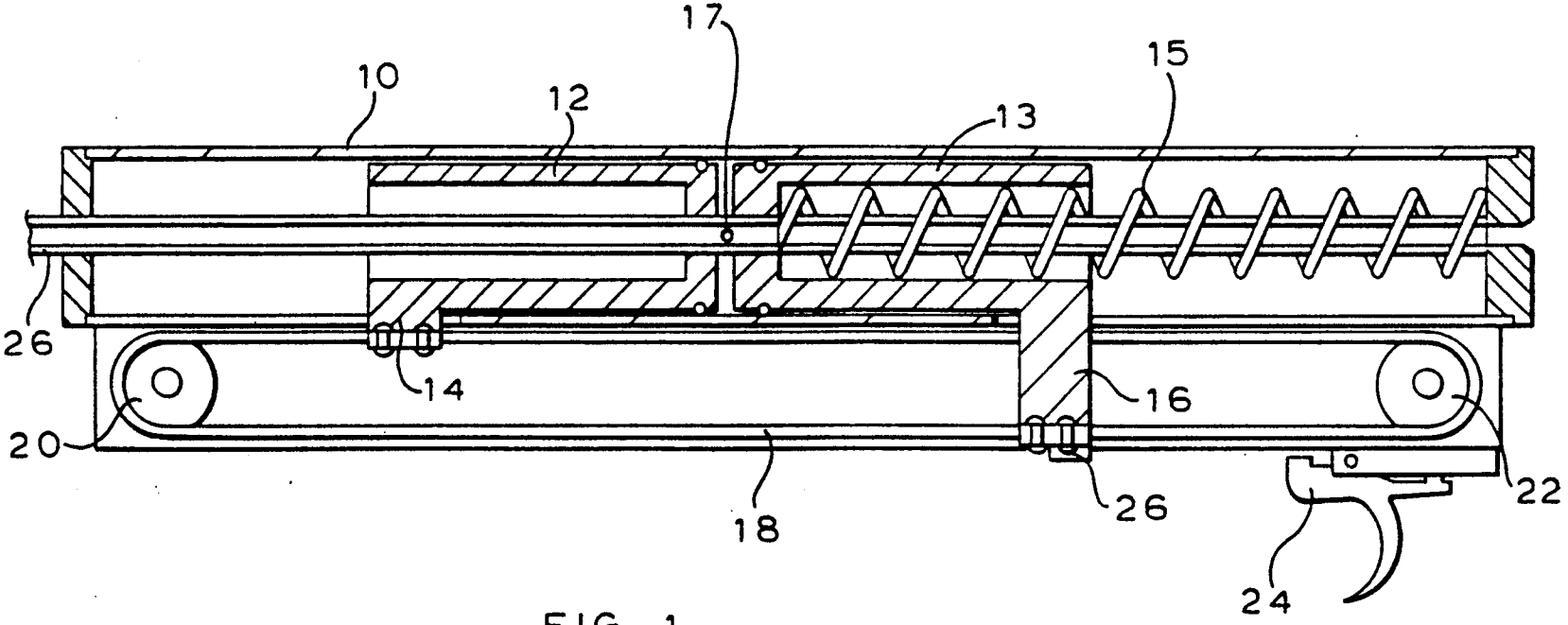
FIG. 1 is a schematic sectional view showing part of an air gun embodying the invention in the released or uncocked position.

Referring to FIG. 1, an air gun comprises an air cylinder 10 within which are mounted two opposed pistons 12,13. The pistons 12,13 are acted on by respective compression springs, the compression spring for the piston 13 being indicated at 12 whilst the compression spring for the piston 12 is omitted for the sake of clarity. Each of the pistons 12,13 has, at its end remote from the other piston, a respective downwardly projecting leg 14,16 which passes through a respective longitudinal slot in the wall of the cylinder, extending from the respective end of the cylinder and terminating just in advance of the position of the respective leg 14,16 adopted in the discharged state of the gun. Disposed below the barrel 10 is an endless flexible drive element 18 which passes around a first reversing pulley 20 at one end of the cylinder and around a further reversing pulley 22 at the opposite end of the cylinder 10, so that between the pulleys 20,22 the element 18 extends in two straight runs, each parallel with the axis of the cylinder 10. The leg 14 of piston 12 is secured to the element 18 at a point on the upper run whilst the leg 16 of the piston 13 is secured to the element 18 at a point on the lower run. It will be appreciated that, as long as the connection points of the legs 14,16 with the element 18 remain on the respective straight runs of the element 18, the pistons 12,13 will be constrained to follow equal but opposite movements. Thus, when the gun is cocked by a cocking mechanism (not shown) the piston 13 is drawn to the right in FIG. 1 until a sear on the trigger engages a trigger catch lug 26 on the leg 16, the piston 12 being correspondingly moved to the left in FIG. 1 so that there is defined, in the un-slotted central region of the cylinder 10, between the opposing faces of the pistons 12,13, a substantial compression space for the charge of air to be compressed on release of the pistons. An air escape port 17 is formed in the wall of the cylinder 10 at a position mid-way between the pistons 12,13 and is connected with one end of a barrel, indicated schematically at 26, for the projectile to be fired. Thus, when the trigger 24 is pulled, the piston 13 is released and with it the element 18 and piston 12, compressing the charge of air between the pistons, the charge of compressed air passing through the escape port 17 to the barrel 26 to fire the projectile.

Because each piston 12,13 is constrained by the endless flexible element 18 to move in a manner precisely equal and opposite to the other, and spring pressure is not required to maintain the element 18 in a taut condition, the compression springs for the two pistons can be made identical in weight and strength and the pistons 12,13 made identical in weight, thereby ensuring a perfect balance and consequently substantially recoilless action.

The elements 18 may be in the form of a closed loop, such as an endless chain, for example a roll-chain similar to a bicycle chain or may be in the form of a flexible belt, such as a V-belt or a rope or flexible cable. Where the element 18 is in the form of a roller chain, for example, the pulleys 20,22 may be replaced by corresponding sprockets.

Figure 2:
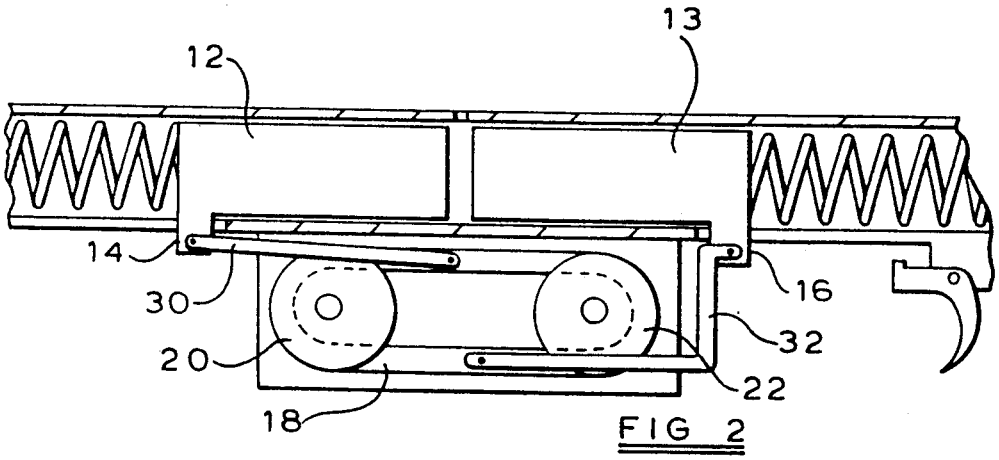
FIG. 2 is a corresponding view of a variant.
Figure 3:
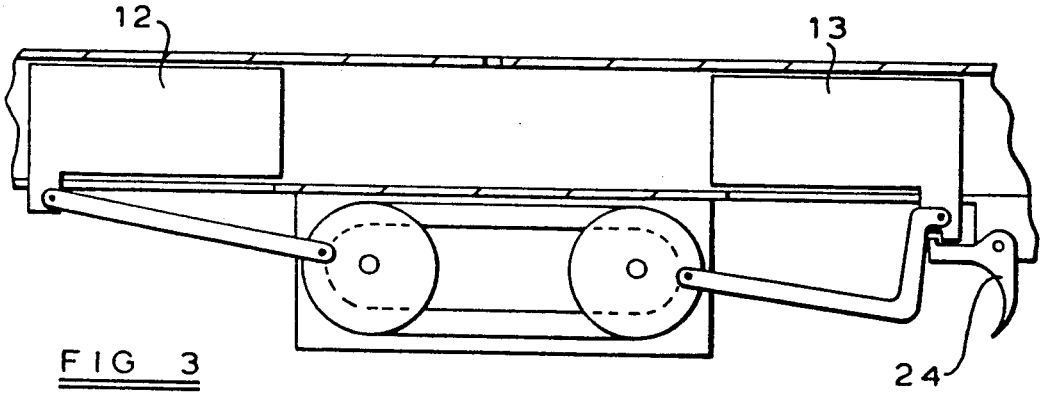
FIG. 3 is a view corresponding to FIG. 2 but showing the gun in the cocked position.

Referring to FIGS. 2 and 3, in which parts corresponding to parts in FIG. 1 have corresponding reference numerals, the pistons 12,13 are connected to their respective attachment points on the flexible element 18 by respective connecting rods 30,32, each connecting rod being pivotally connected to the respective leg 14,16 at one end and being pivotally connected, at its other end to the respective part of the drive element 18, for example to a plate or bracket (not shown) secured to the element 18. The arrangement is such as to allow the points of pivotal attachment of the connecting rods 30,32 to move simultaneously partially around the respective pulleys 20,22 during the cocking the gun. As the pistons 12,13 move into their final, fully-cocked positions, shown in FIG. 3. In this condition of the gun, because the line of action, through the connecting rod 30, of the force acting between the respective piston 12 and the element 18 passes close to the rotary axis of the pulley 20, this force is largely received by the bearings of the respective pulley 20 and contributes little to the tension in the element 18 and hence to the force which must be resisted by the trigger 24, allowing the loading on the trigger 24 to be substantially halved. It will be appreciated that a further reduction of the loading on the trigger may be achieved by arranging for example, for the trigger to act, instead of on the leg 16 integral with the piston 13, on a sear element (not shown) mounted on the element 18 and arranged to be engaged by the trigger when the gun is in the cocked position shown in FIG. 3 in which the spring forces on the two pistons are resisted largely by the bearings of the two pulleys 20,22.

It will be appreciated that, in the arrangements of FIGS. 1 to 3, once the trigger has been released, because of the essentially balanced nature of the pistons 12,13 and their respective springs, there is normally negligible tension in the element 18 whilst it is in motion, so that the pulleys 20,22 and the element 18 are subjected to relatively little wear.

It will be appreciated that the drawings are highly schematic and that such factors as the disposition of the projectile barrel 26 in relation to the cylinder 10 may be varied as will be evident to those skilled in the art, as may be the position of the cylinder 10 in relation to the endless element 18. For example the cylinder 10 might be disposed between the two runs of the element 18 and so on. Likewise, any suitable lever system may be provided for cocking the gun.

I claim:

1. A recoilless air gun comprising a piston and a counterweight arranged to be propelled simultaneously in opposite directions when the gun is fired, to cause said piston to compress a charge of air to propel a projectile from the gun, wherein said piston and said counterweight are each attached to an endless flexible driving element in the form of a closed loop, supported for circulating movement around a closed path such that in such circulating movement in one sense the driving element passes along a first run in one direction, around first reversing means, along a second run parallel with the first run, in the direction opposite to said first direction, and around second reversing means into said first run again, a point of attachment of said piston and a point of attachment of said counterweight being such that the point of attachment of said piston is in said first run when the point of attachment of said counterweight is in said second run whereby the piston and counterweight are constrained to move in opposite directions, said runs being parallel with one another and with said direction of movement of the piston and counterweight.

2. A recoilless gun according to claim 1 wherein said counterweight it is a further piston likewise operable to compress air to fire said projectile.

3. A recoilless gun according to claim 1 wherein said endless flexible driving element is a chain.

4. A recoilless gun according to claim 1 wherein said endless flexible driving element is a belt.

5. A recoilless gun according to claim 1, wherein said piston and said counterweight, or said piston where the counterweight is in the form of a further piston, are connected to said endless flexible driving element by respective connecting rods or links, in such a manner is to allow a line of action connecting the point of attachment of said connecting rod or link with the flexible driving element and the point of attachment of the connecting rod or link with its piston, to vary in inclination relative to said runs, so that the end of each connecting rod or link connected with the flexible driving element can follow the latter at least partially around the respective reversing means, to respective positions where a larger part of the restraining force resisting a biasing means is provided by said reversing means and a smaller part by a release mechanism.

* * * * *